US007685818B2

(12) United States Patent
Beale

(10) Patent No.: US 7,685,818 B2
(45) Date of Patent: Mar. 30, 2010

(54) CONNECTION OF A FREE-PISTON STIRLING MACHINE AND A LOAD OR PRIME MOVER PERMITTING DIFFERING AMPLITUDES OF RECIPROCATION

(75) Inventor: William T. Beale, Athens, OH (US)

(73) Assignee: Sunpower, Inc., Athens, OH (US)

( * ) Notice: Subject to any disclaimer, the term of this patent is extended or adjusted under 35 U.S.C. 154(b) by 248 days.

(21) Appl. No.: 11/755,436

(22) Filed: May 30, 2007

(65) Prior Publication Data

US 2008/0295511 A1 Dec. 4, 2008

(51) Int. Cl.
*F01B 29/10* (2006.01)

(52) U.S. Cl. ..... 60/517; 60/525; 60/526

(58) Field of Classification Search ..... 60/517–526
See application file for complete search history.

(56) References Cited

U.S. PATENT DOCUMENTS 5,483,802 A * 1/1996 Kawajiri et al. ..... 62/6
5,502,968 A * 4/1996 Beale ..... 62/6
5,920,133 A * 7/1999 Penswick et al. ..... 310/17

* cited by examiner

*Primary Examiner*—Hoang M Nguyen
(74) *Attorney, Agent, or Firm*—Frank H. Foster; Kremblas, Foster, Phillips & Pollick

(57) ABSTRACT

The reciprocatable power piston of a free-piston Stirling machine is drivingly linked to a reciprocatable component body of an associated apparatus by at least one spring with no rigid connection linking the piston to the component body. The spring drive linkage allows the power piston and the reciprocatable component body of the associated apparatus to reciprocate at different amplitudes of oscillation. Therefore, the Stirling machine and the associated apparatus can be optimized at different amplitudes of piston and the component body oscillation thereby improving the optimization of two very different dynamic systems that are drivingly connected together.

13 Claims, 5 Drawing Sheets

CONNECTION OF A FREE-PISTON STIRLING MACHINE AND A LOAD OR PRIME MOVER PERMITTING DIFFERING AMPLITUDES OF RECIPROCATION

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to the field of Stirling machines connected to a reciprocatable body that is a component of an associated apparatus, the associated apparatus being a load such as a linear alternator driven by a Stirling engine or a prime mover such as a linear motor that drives a Stirling heat pump (cooler), and more particularly relates to an improved link between the piston of the Stirling machine and the reciprocatable component body, for allowing improved optimization of both the Stirling machine and the associated apparatus.

2. Description of the Related Art

Stirling machines have been known for nearly two centuries but in recent decades have been the subject of considerable development because they offer important advantages. Modern versions have been used as engines and heat pumps for many years in a variety of applications. In a Stirling machine, a working gas is confined in a working space comprised of an expansion space and a compression space. The working gas is alternately expanded and compressed in order to either do work or to pump heat. Each Stirling machine has a pair of pistons, one referred to as a displacer and the other referred to as a power piston and often just as a piston. Some Stirling machines have multiple sets of these pistons. The reciprocating displacer cyclically shuttles a working gas between the compression space and the expansion space which are connected in fluid communication through a heat accepter, a regenerator and a heat rejecter. The shuttling cyclically changes the relative proportion of working gas in each space. Gas that is in the expansion space, and/or gas that is flowing into the expansion space through a heat exchanger (the accepter) between the regenerator and the expansion space, accepts heat from surrounding surfaces. Gas that is in the compression space, and/or gas that is flowing into the compression space through a heat exchanger (the rejecter) between the regenerator and the compression space, rejects heat to surrounding surfaces. The gas pressure is essentially the same in both spaces at any instant of time because the spaces are interconnected through a path having a relatively low flow resistance. However, the pressure of the working gas in the work space as a whole varies cyclically and periodically. When most of the working gas is in the compression space, heat is rejected from the gas. When most of the working gas is in the expansion space, the gas accepts heat. This is true whether the Stirling machine is working as a heat pump or as an engine, as discussed below. The only requirement to differentiate between work produced or heat pumped, is the temperature at which the expansion process is carried out. If this expansion process temperature is higher than the temperature of the compression space, then the machine is inclined to produce work so it can function as an engine and if this expansion process temperature is lower than the compression space temperature, then the machine will pump heat from a cold source to a warm heat sink.

Stirling machines can therefore be designed to use the above principles to provide either: (1) an engine having a piston and displacer driven by applying an external source of heat energy to the expansion space and transferring heat away from the compression space and therefore operating as a prime mover driving a mechanical load, or (2) a heat pump having the power piston cyclically driven by a prime mover for pumping heat from the expansion space to the compression space and therefore capable of pumping heat energy from a cooler mass to a warmer mass. The heat pump mode permits Stirling machines to be used for cooling an object in thermal connection to its expansion space, including to cryogenic temperatures, or heating an object, such as a home heating heat exchanger, in thermal connection to its compression space. Therefore, the term Stirling "machine" is used to generically include both Stirling engines and Stirling heat pumps.

Until about 1965, Stirling machines were constructed as kinematically driven machines meaning that the piston and displacer are connected to each other by a mechanical linkage, typically connecting rods and crankshafts. The free piston Stirling machine was then invented by William Beale. In the free piston Stirling machine, the pistons are not connected to a mechanical drive linkage. A free-piston Stirling machine is a thermo-mechanical oscillator that is an energy transducer converting energy between thermal and mechanical forms of energy. One of its pistons, the displacer, is driven by working gas pressure variations and pressure differences in spaces or chambers in the machine. The other piston, the power piston, is either driven by a reciprocating prime mover when the Stirling machine is operated in its heat pumping mode or drives a reciprocating mechanical load when the Stirling machine is operated as an engine. Free piston Stirling machines offer numerous advantages including the ability to control their frequency, phase and amplitude, the ability to be hermetically sealed from their surroundings and their lack of a requirement for a mechanical fluid seal between moving parts to prevent the mixing of the working gas and lubricating oil.

Free-piston Stirling machines designed and operated in either the engine mode or the heat pumping mode are capable of being, and have been, connected to a diverse variety of associated apparatuses. Free-piston Stirling engines provide output power in the form of mechanical reciprocation and therefore can be linked as a prime mover to drive mechanical loads as the associated apparatus. These loads include linear electric alternators, compressors, fluid pumps and even Stirling heat pumps. Similarly, free-piston Stirling machines operated in a heat pump mode can be driven as a load by other prime movers as the associated apparatus, including linear motors and Stirling engines.

Stirling machines are often connected to a linear motor or linear alternator. Both an electric linear motor and an electric linear alternator are the same basic device. At times they are referred to collectively as motor/alternator or similar term since both have many identical characteristics. They have a stator, ordinarily having an armature winding, and a reciprocating component body that ordinarily includes magnets, usually permanent magnets, that can reciprocate within the armature winding. The power piston of the Stirling engine is connected to the reciprocating component body of the linear alternator to reciprocate the magnets within the armature winding and thereby generate electric power. Similarly, when a Stirling machine is operated in a heat pumping mode and driven by a linear electric motor, the reciprocating component body of the linear electric motor is connected to the power piston of the Stirling heat pump. Whether the Stirling machine is operated as an engine or a heat pump, the power piston of the Stirling machine is, in the prior art, directly connected to the reciprocating component body of the linear motor or alternator by a rigid or fixed connection or link. Consequently, the piston of the Stirling machine and the reciprocating component body of the linear alternator or linear motor reciprocate as a unit at the same frequency and the same amplitude of oscillation. This direct connection is typically accomplished by mounting the magnets to a magnet carrier or framework that is mounted to the power piston, but sometimes they are connected by a connecting rod. Other combinations of a free-piston Stirling machine and an associated apparatus also have the power piston of the Stirling machine linked by a rigid connection to the reciprocating body of the associated apparatus so that they reciprocate as a unit.

Although the prior art discloses a large quantity of combinations of a free-piston Stirling machine and an associated apparatus, FIGS. 1 and 2 illustrate a representative example of a free-piston machine coupled to a electric linear motor or linear alternator as the associated apparatus. The Stirling machine and the linear motor/alternator are often mechanically integrated to some extent so they do not appear in FIG. 1 as two easily distinguished machines in a simple side by side arrangement. Referring to FIG. 1, a linear electric motor/alternator 10 has an armature winding 16. A Stirling machine 12 has a power piston 18 that reciprocates axially within a cylinder 19 at an operating amplitude and frequency of reciprocation. A reciprocating component body of the motor/alternator comprises a magnet carrier 17 that is rigidly fixed to the power piston 18 and a series of permanent magnets 20 that are fixed to and supported by the carrier 17. The permanent magnets 20 reciprocate axially (parallel to axis 21) in an air gap within the armature winding 16 at the operating frequency of reciprocation. Consequently, because the piston 18, the magnets 20 and their support carrier 17 are integrated together, the piston and the reciprocating body of the motor/alternator are a single unit with power piston 18 and the magnets 20 rigidly connected together and therefore reciprocating at the same amplitude and frequency. The displacer 22 of the Stirling machine is fixed to one end of a connecting rod 24 and the opposite end of the connecting rod 24 is connected to a planar spring 25 so that the displacer 22 and its connecting rod 24 can also reciprocate axially at the operating frequency of reciprocation. The Stirling machine also has heat exchangers 26 and 28 and an interposed regenerator 30 through which working gas is shuttled between the expansion space A and compression space B.

The operating frequency of a combination like that shown in FIG. 1 is typically approximately the resonant frequency of the mass of the piston 18 and its attached masses and the spring forces, principally the spring forces of the planar spring 25 and the gas spring forces of the working gas within the hermetically sealed machine. Free piston Stirling machines typically operate in the frequency range from about 30 Hz to 120 Hz. The operating frequency of a Stirling machine may vary slightly under differing operating conditions, but ordinarily that variation is very small, not exceeding a few Hz. A Stirling machine may, for some applications, be operated at a frequency that is near but slightly displaced from its natural frequency of oscillation, but is operated at a frequency within the range of its resonance peak. However, the amplitude of the power piston 18, and with it the amplitude of the reciprocating body of the motor/alternator 10, may vary considerably as a function of variations in operating conditions, such as the electrical power output of a linear alternator.

FIG. 2 is a more diagrammatic illustration of the combination of a Stirling machine and a linear motor/alternator that is illustrated in FIG. 1. FIG. 2 is more simplified for facilitating explanation of the invention and uses the same reference numerals used in FIG. 1 for identifying the same parts. The rigid connection of the power piston 18 of the Stirling machine to the magnet carrier 17 and its magnets 20, which form the reciprocating component body of the motor or alternator, is illustrated in FIG. 2 as bars or connecting rods 34 rigidly connecting the magnet carrier 17 to the power piston 18.

Whenever a free-piston Stirling machine is connected to an associated apparatus that is either a load that it drives or a prime mover that drives it, the combination involves a connection and interaction of two dynamic systems. An engineer designing such a combination typically attempts to optimize one or more characteristics of the combination by finding an optimum operating point for the combined system. One characteristic that is important to optimization is the amplitude of oscillation. Unfortunately, because the dynamic systems are so different, it is not unusual for the optimum operating point for each system to be different from the optimum operating point for the other system. Since the optimum operating points of the two systems do not coincide, the traditional approach is to make the best available engineering compromises and tradeoffs between the two systems.

For example, the design of a high power electrical generating system, in which a free-piston Stirling engine drives a linear alternator, involves the interaction of the dynamics of the thermodynamic cycle of the engine and the dynamics of the electromagnetic alternator system. Optimum linear power densities occur at higher amplitudes of alternator oscillation. However, modifying the design of free-piston Stirling engine so that it provides a greater amplitude of oscillation that is closer to the optimum alternator operating amplitude, eventually leads to a free-piston Stirling engine that can not reciprocate the alternator effectively. In other words, the operating amplitude for optimum alternator operation does not coincide with the operating amplitude for optimum free-piston Stirling engine operation.

The necessity for engineering compromises and tradeoffs resulting from the lack of coincidence of the optimum operating amplitude of reciprocation for each of two interconnected but very different dynamic systems also applies to other combinations in which a free-piston Stirling machine is connected to an associated apparatus. The traditional direct, rigid connection of the piston of the free-piston Stirling machine to its load or prime mover limits the engineer to combined systems in which both have the same operating amplitude of reciprocation.

It is therefore a purpose and feature of the present invention to provide an improvement in a free-piston Stirling machine connected to an associated apparatus that is a load or prime mover, wherein the improvement permits the free-piston Stirling machine and the associated apparatus to operate at different amplitudes of oscillation and thereby allow better optimization of each.

BRIEF SUMMARY OF THE INVENTION

The invention is an improved combination of a free-piston Stirling machine, including its reciprocatable power piston, drivingly linked to an associated apparatus having a reciprocatable component body that is part of a mechanical load that the Stirling machine drives or part of a prime mover that drives the Stirling machine. The improvement is at least one spring connected to and drivingly linking the piston to the component body while having no rigid connection linking the piston to the component body. The substitution of the spring drive linkage for the rigid drive linkage allows the power piston and the reciprocatable component body of the associated apparatus to reciprocate at different amplitudes of oscillation. Therefore, the Stirling machine and the associated apparatus can be optimized at different amplitudes of piston and component body oscillation thereby accommodating the difference in the amplitudes at which the two very different dynamic systems operate optimally.

Figure 1:
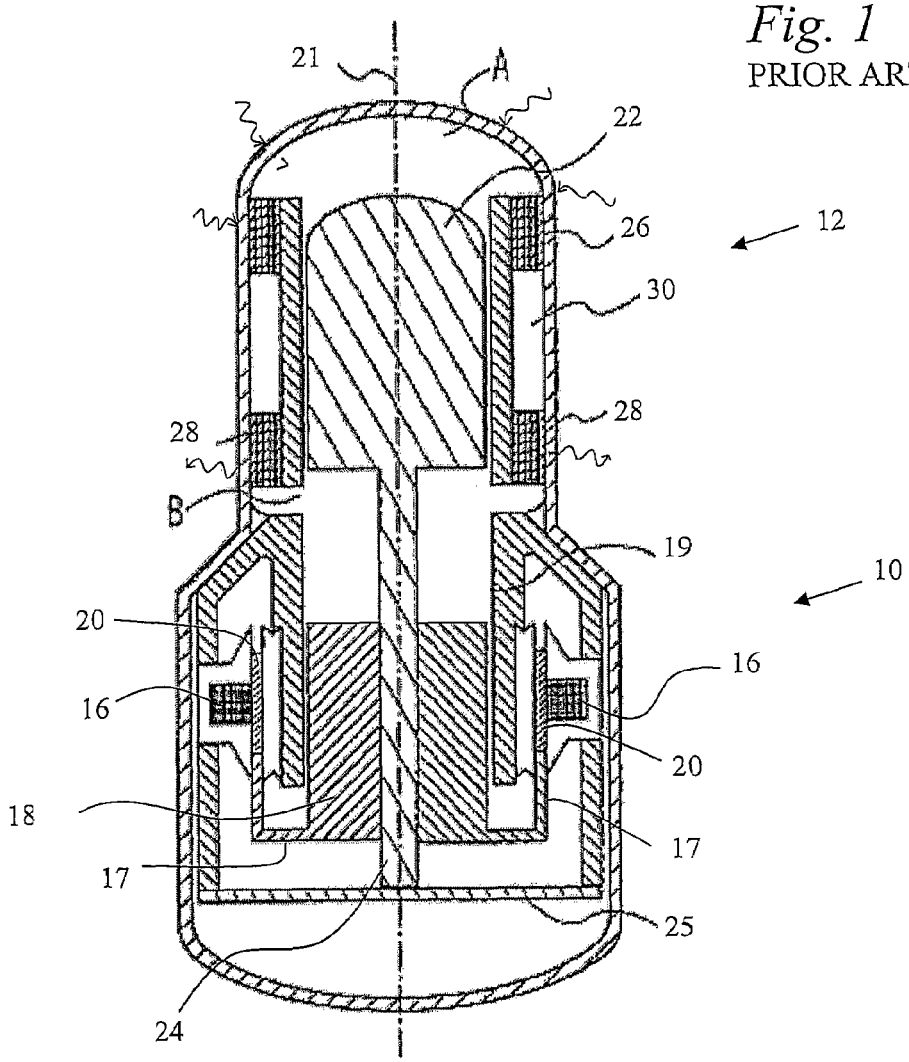
Fig. 1 PRIOR ART
FIG. 1 is a view in axial section illustrating an example of a combination free-piston Stirling machine drivingly linked to a linear electric motor or alternator as found in the prior art.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Figure 2:
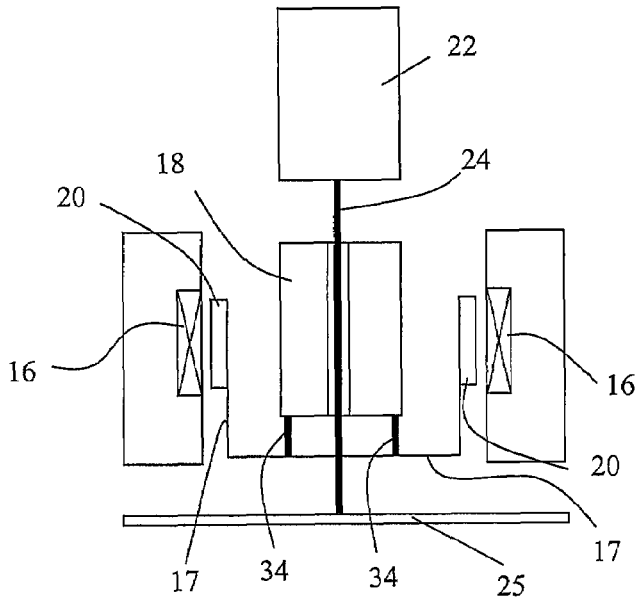
Fig. 2 PRIOR ART
FIG. 2 is a diagrammatic illustration of the combination illustrated in FIG. 1.
Figure 3:
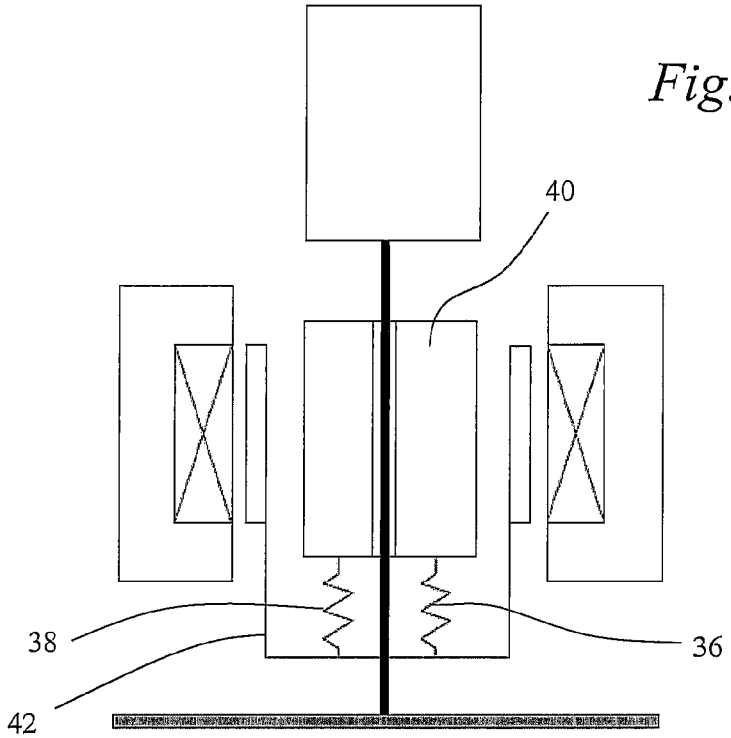
FIG. 3 is a diagrammatic illustration of a preferred embodiment of the invention.

FIG. 3 illustrates an embodiment of the invention. The rigid connection symbolized by the bars or connecting rods 34 in FIG. 2 are replaced by at least one spring 36 in FIG. 3. More particularly, with the invention, at least one spring is connected to and drivingly links the power piston of the Stirling machine to the reciprocatable component body of the associated apparatus that is drivingly linked to the Stirling machine for driving or being driven by the Stirling machine. Importantly, there is no rigid connection linking the piston to the component body which would negate the effect of the spring. Because the piston and the reciprocatable component body of the associated machine are drivingly connected by a spring, the power piston and the component body are able to reciprocate at different amplitudes of oscillation but at the same operating frequency. The theory of operation and the manner of designing the Stirling machine, the spring and the associated apparatus are subsequently described. However, first structural preferences and alternatives are described.

The prior art illustrates many different kinds of springs. These include coil springs, planar springs and gas springs which may be used in embodiments of the invention. Springs have the common characteristic that, as they are displaced from their relaxed state by an applied force, they store energy and they apply a force that is a function of their displacement. Most commonly, the force applied by a spring is a linear function of the spring displacement. That relationship is conventionally expressed by a proportionality constant known as a spring constant k. Many springs, such as coil springs, not only apply an axial force to the bodies to which they are connected, but also apply a torque to those bodies as a result of rotation, around the axis of the spring as the spring is displaced, of one end of the helical spring relative to the other end. However, that torque can be canceled by using two identical springs with oppositely wound helical coils. Consequently, it is preferred that there be an even number of springs, such as springs 36 and 38, connected to and drivingly linking the piston 40 to the reciprocatable component body 42 for canceling any torque force exerted by the springs when an axial force is applied to them. Of course any number of springs could be used and designed so the sum of the torque of all of them is close to zero.

Figure 4:
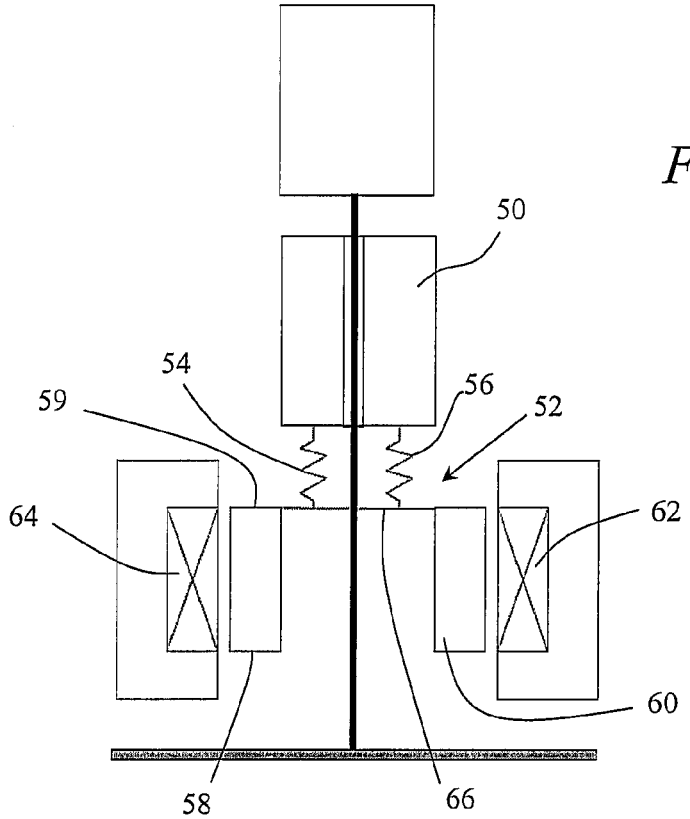
FIG. 4 is a diagrammatic illustration of an alternative embodiment of the invention.

FIG. 4 illustrates an embodiment in which the power piston 50 is axially spaced from a reciprocatable component body 52 of a linear motor/alternator and is drivingly linked to it by a pair of springs 54 and 56. The reciprocatable component body 52 carries the alternator/motor magnets 58 and 60 that reciprocate adjacent armature coils 62 and 64. Because the power piston 50 is axially spaced from the magnets, the magnet carrier 66 is at the proximal end 59 of the reciprocatable component body 52.

Figure 5:
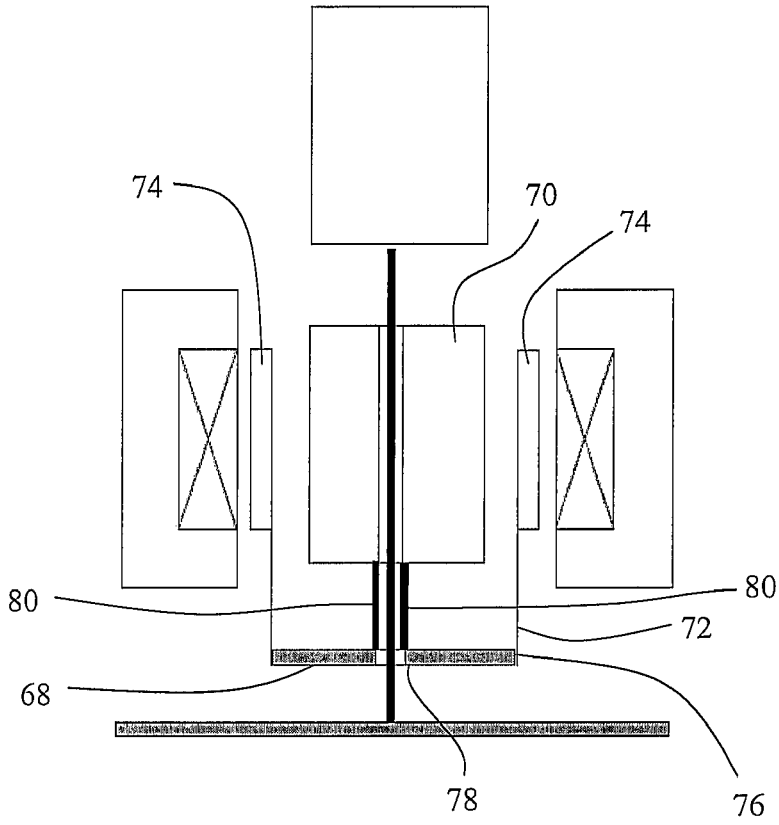
FIG. 5 is a diagrammatic illustration of another alternative embodiment of the invention.

FIG. 5 illustrates the use of a planar spring 68, instead of the coil springs illustrated in FIGS. 3 and 4, to drivingly link the power piston 70 to a reciprocatable body 72 that includes magnets 74. The usual attachment points to a planar spring are at the outer periphery 76 and at the center 78. The magnet carrier 72 is attached to the outer periphery 76 and the power piston 70 is attached to the center 78 of the planar spring 68 by connecting rods 80. The other components illustrated in FIG. 5 are like those illustrated in FIGS. 2-4.

Figure 6:
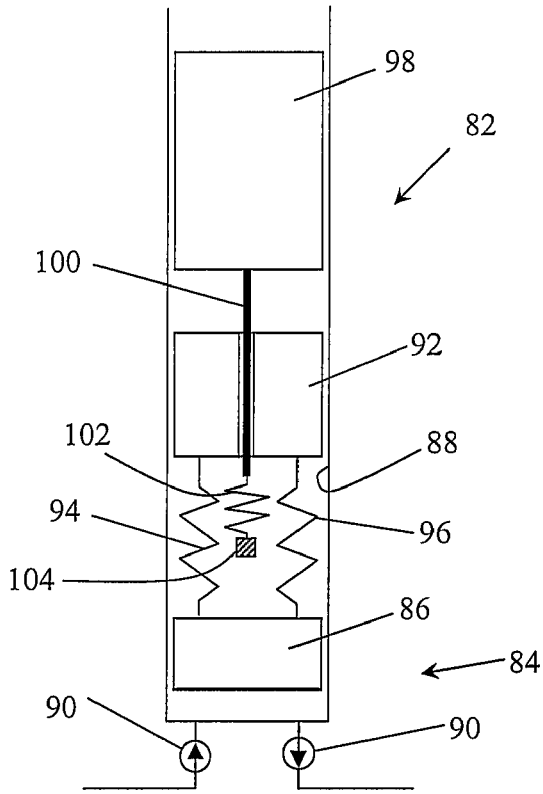
FIG. 6 is a diagrammatic illustration of yet another alternative embodiment of the invention.

FIG. 6 illustrates a free-piston Stirling machine linked to a different type of associated apparatus 84. The associated apparatus 84 of FIG. 6 has a piston 86 sealingly slidable in cylinder 88 with valves 90. As known to those skilled in the art, a piston in a valved cylinder can be constructed to form a compressor or a fluid motor so that it can be driven and operated as a gas compressor or fluid under pressure can be applied to it so it is operated as a motor that can drive another load, such as a Stirling cooler. However, considering the associated apparatus 84 as a compressor and the Stirling machine as a Stirling engine 82, the compressor piston 86 is drivingly linked to the power piston 92 of the Stirling engine 82 by a pair of springs 94 and 96. As in the other embodiments, a displacer 98 has a piston connecting rod 100 that slidingly and sealingly extends through the power piston 92 to a spring 102. The spring 102 springs the displacer to "ground" by its connection at its opposite end to a bridge 104 attached to and extending across between diametrically opposite walls of the cylinder 88.

The Engineering

The purpose of the invention is to permit the design of a combination of a free-piston Stirling machine drivingly linked to an associated reciprocating apparatus in which the piston of the free-piston Stirling machine can oscillate in reciprocation at a different amplitude of oscillation than the amplitude of oscillation of the reciprocating component body of the associated apparatus. The purpose of providing a structure that allows these reciprocating masses to oscillate at different amplitudes is to permit the free-piston Stirling machine and the associated reciprocating apparatus to be operated at different amplitudes when they are better optimized at different amplitudes. In order for engineers to be able to design embodiments of the invention that allow the different amplitudes of oscillation, it is necessary that the engineers know the relationships between the physical parameters and operating variables of the embodiments. Although the derivation of these relationships is given at the end of this description, some practical results are first discussed.

The ratio of the amplitudes of oscillation of the piston of the Stirling engine and the component reciprocating body of the associated apparatus is:

$$\left|\frac{X_2}{X_1}\right| = \frac{1}{\left[\left(1-\frac{\omega^2}{\omega_n^2}\right)^2 + \left(2-\frac{\omega}{\omega_n}\frac{c_l}{c_c}\right)^2\right]^{\frac{1}{2}}} \quad \text{(eq. I)}$$

wherein the variables are:

$X_1$=piston amplitude;

$X_2$=associated reciprocating component body amplitude;

$\omega$=the operating radian frequency;

and wherein the structural parameters of the combination free-piston Stirling machine and the drivingly linked associated apparatus are:

$\omega_n$—the natural frequency of oscillation of the component reciprocating body which is $$\omega_n = \sqrt{\frac{k_s}{m_2}}; \quad \text{(eq. II)}$$

$k_s$—the spring constant of the spring that drivingly links the piston of the free-piston Stirling machine to the component reciprocating body of the associated apparatus;

$m_2$—the mass of the component reciprocating body of the associated apparatus;

$c_c$—the critical damping constant $c_c=2\sqrt{k_s m_2}$ of the component reciprocating body of the associated apparatus; and $c_l$—an equivalent damping constant for damping of the reciprocating component body.

The above parameters and variables are conventionally known except for the equivalent damping constant $c_l$. The equivalent damping constant $c_l$ is a physical parameter that is a characteristic of an associated apparatus such as a linear motor or alternator. In the case of a linear motor/alternator, the equivalent damping constant $c_l$ represents damping of the motor/alternator by power consumption in the motor/alternator circuit. It allows the damping force on the motor/alternator reciprocating body, which results from that electrical power consumption, to be expressed as the product of a damping constant $c_l$ and the velocity $\dot{x}_2$ of the motor/alternator reciprocating body. The equivalent damping constant $c_l$ is defined by:

$$c_l = \alpha\frac{di}{d\dot{x}_2}; \quad \text{(eq. III)}$$

wherein i is motor/alternator current, $\dot{x}_2$ is the velocity of the reciprocating component body and $\alpha$ is the motor constant. The motor constant $\alpha$ is a parameter that represents a physical characteristic of a motor/alternator and is known to those skilled in the art to be defined by:

$$\alpha = \frac{v(alt./\text{motor}-\text{voltage})(\text{volts})}{\dot{x}_2(alt./\text{motor}-\text{velocity})(\text{m/sec})} \quad \text{(eq. IV)}$$

$$= \frac{\text{force(newtons)}}{alt./\text{motor}-\text{current(amps)}}.$$

Similarly, $$\frac{di}{d\dot{x}_2},$$

which is the differential rate of change of motor/alternator current with respect to the velocity $\dot{x}_2$ of the reciprocating component body, is a physical parameter that is a characteristic of a motor/alternator. Motor/alternator current is proportional to the velocity of the reciprocating component body, such as the typical reciprocating magnets.

$$\frac{di}{d\dot{x}_2}$$

is the proportionality constant. Although di and $d\dot{x}_2$ are each operating variables, their ratio is a slope of a graph of i vs. $\dot{x}_2$. Therefore, $\alpha$ and $$\frac{di}{d\dot{x}_2}$$

are both constant values that are physical characteristics of each particular motor/alternator that can be designed into it.

The above equation I is conveniently expressed in terms of dimensionless ratios, specifically the amplitude ratio $$\left|\frac{X_2}{X_1}\right|,$$

the frequency ratio $$\frac{\omega}{\omega_n}$$

and the damping ratio $$\frac{c_l}{c_c}.$$

Figure 7:
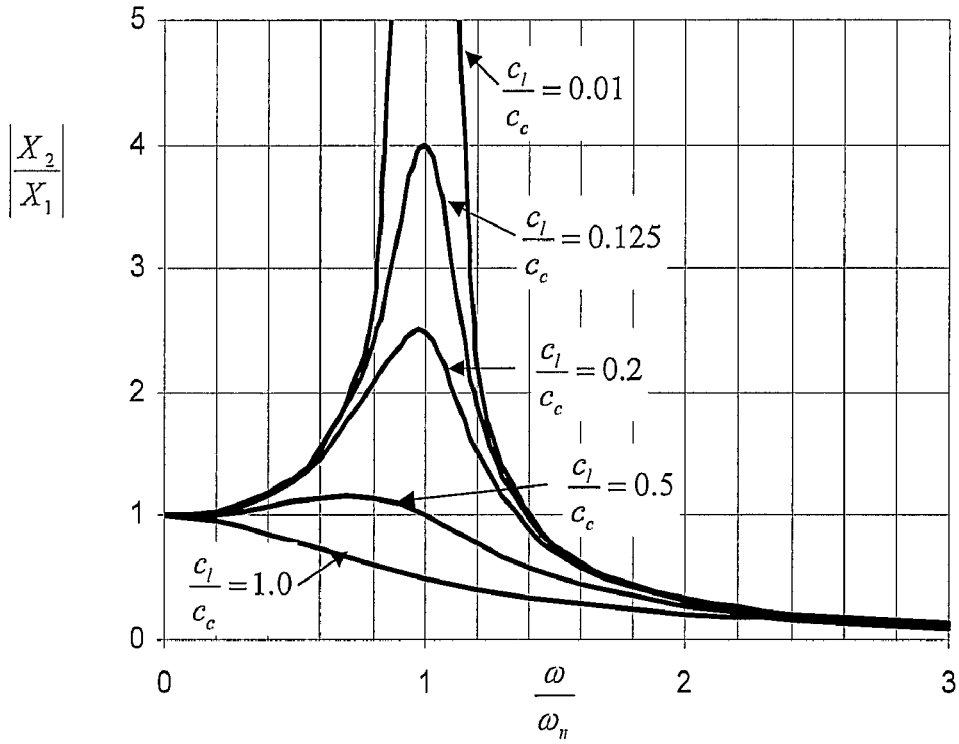
FIG. 7 is a graph illustrating the design, engineering, and operation of embodiments of the invention.

FIG. 7 is a graph of equation I and shows the amplitude ratio plotted as a function of the frequency ratio for a family of damping ratios. The graph of FIG. 7 exhibits resonance peaks for an operating frequency around the natural frequency $\omega_n$; that is, around a frequency ratio of 1. The graph of FIG. 7 shows that the amplitude of the reciprocatable component body of the associated apparatus, such as a motor/alternator, is greater than the amplitude of the piston when the combination is operated at a frequency somewhere on a resonance peak and the damping ratio is less than approximately 0.5. In other words and for a motor/alternator, the amplitude ratio is greater than 1 when the damping due to electrical power dissipation in the motor/alternator circuit, represented by the equivalent damping constant $c_l$, is less than half the critical damping constant $c_c$ and the Stirling machine is tuned to operate near the alternator resonance frequency. Furthermore, when the damping ratio is less than 0.2, the amplitude ratio exceeds 2 over a range of frequency ratio extending from a frequency ratio of 0.75 to 1.1.

For operation at the resonance (natural) frequency $\omega_n$, equation I simplifies to $$\left|\frac{X_2}{X_1}\right| = \frac{k_s}{\omega_n c_l} = \frac{\sqrt{k_s m_2}}{c_l} = \frac{c_c}{2c_l}. \quad \text{(eq. V)}$$

This equation defines the operating amplitude ratio for operation at resonance of an embodiment of the invention that has the structural parameters $k_s$, $m_2$ and $c_l$ related as described by equation V. In other words, this equation describes the structural/physical relationships that give the amplitude ratio $$\left|\frac{X_2}{X_1}\right|$$

if operated at resonance. Of course a combination of a free-piston Stirling machine and an associated apparatus can be operated slightly off its resonant frequency $\omega_n$. In that case the amplitude ratio will decrease from the ratio given by equation V as illustrated in FIG. 7. Nonetheless, even when operated off resonance, equation V describes the relationship of the structural parameters of the embodiment and the amplitude ratio it would have if operated at the resonance peak. In other words, equation V describes the structural features of an embodiment of the invention regardless of the frequency at which that machine is actually operated.

The Mathematical Derivation

1. Model for Piston and Alternator

Figure 8:
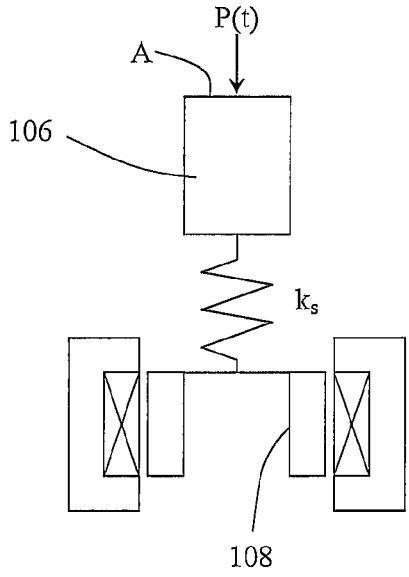
FIG. 8 and FIG. 9 illustrate the mathematical model for deriving the equations that express the relationship of the variables and structural parameters of embodiments of the invention.
Figure 9:
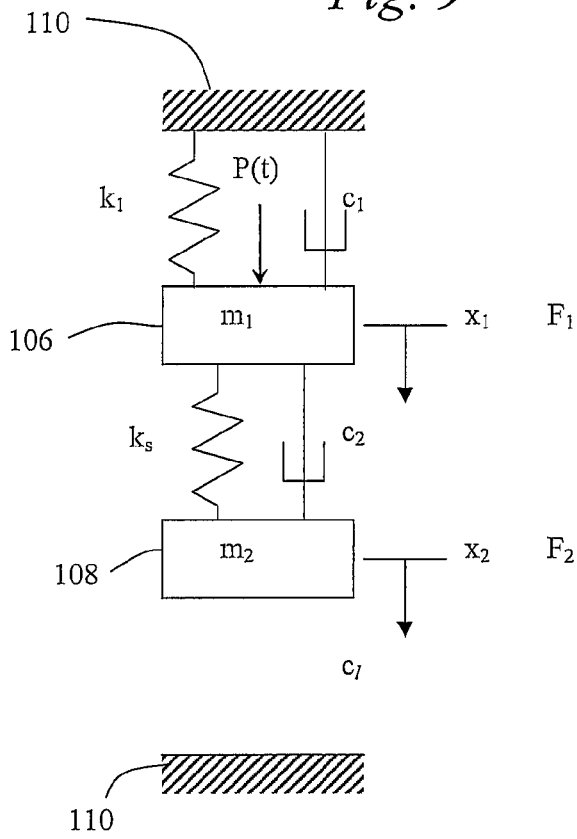
Figure 10:
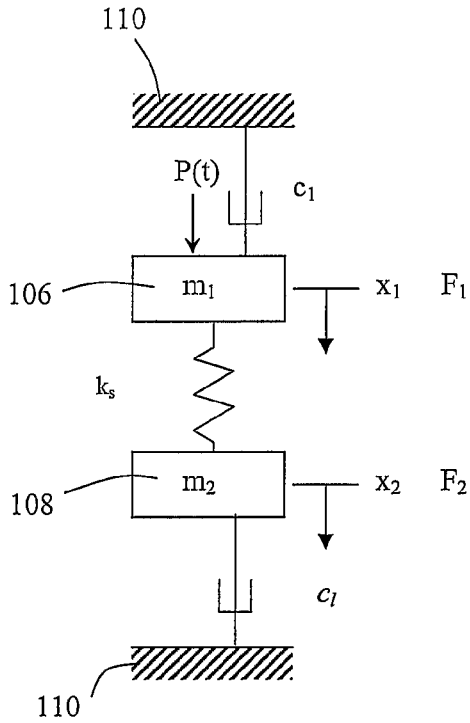
FIG. 10 is a simplification of FIG. 9 based upon ignoring some of the components of the generalized model of FIG. 9 because they are small or non-existent in practical embodiments of the invention.

FIGS. 8, 9 and 10 illustrate dynamic models for the mathematical analysis. The analysis is described for a Stirling engine driving a linear alternator but the same analysis is applicable to a Stirling machine operating in a heat pumping mode driven by a linear alternator. For simplicity, if we only focus on the motion of a piston 106 and an alternator moving component body 108 and neglect the motion of a displacer and a surrounding case 110, the system can be modeled, as shown in FIG. 9, and mathematically modeled by summing the forces applied to the piston 106 and summing the forces applied to the alternator moving component body 108, $$m_1\ddot{x}_1+c_1\dot{x}_1+k_1x_1+c_2(\dot{x}_1-\dot{x}_2)+k_s(x_1-x_2)=F_1=P(t)A \quad \text{eq. (1)}$$

$$m_2\ddot{x}_2+c_2(\dot{x}_2-\dot{x}_1)+k_s(x_2-x_1)=F_2 \quad \text{eq. (2)}$$

where $m_1$ is the piston mass, $m_2$ is the alternator moving component mass, P(t) is the pressure change in the compression space (B in FIG. 1) and A is the piston area. However, since there is no mechanical spring ($k_1$) on the piston and no damping ($c_2$) between the piston and the alternator, those parameters become zero, and we can simplify equations (1) and (2) to give the equations, $$m_1\ddot{x}_1+c_1\dot{x}_1+k_sx_1-k_sx_2=P(t)A \quad \text{eq. (3)}$$

$$m_2\ddot{x}_2+k_sx_2-k_sx_1=F_2 \quad \text{eq. (4)}$$

The alternator/motor load, $F_2$, is assumed to be a damper because the force exerted on the magnet is proportional to its velocity and closely approximates a free-piston Stirling engine/cooler load in practical examples. Thus the equation (4) will turn to, $$m_2\ddot{x}_2+c_l\dot{x}_2+k_sx_2-k_sx_1=0 \quad \text{eq. (5)}$$

Where $c_l$ is a linear alternator/motor damping coefficient. Consequently, the system has been simplified to the system of FIG. 10.

Since the piston motion is defined in amplitude and frequency and oscillatory pressure change is given, $$x_1=X_1e^{jwt} \quad \text{eq. (6)}$$

$$P=\hat{P}e^{jwt} \quad \text{eq. (7)}$$

Where: $\hat{P}=P_0e^{j\Phi}$

An oscillatory solution to this differential equation is;

$$x_2=\hat{X}_2e^{jwt} \quad \text{eq. (8)}$$

Where: $\hat{X}_2=X_2e^{j\Phi}$

Substituting into eq. (3) and eq. (5) gives:

$$[(k_s-\omega^2m_1)+j\omega c_l]X_1-k_s\hat{X}_2=\hat{P}A \quad \text{eq. (9)}$$

$$[(k_s-\omega^2m_2)+j\omega c_l]\hat{X}_2-k_sX_1=0 \quad \text{eq. (10)}$$

These can be solved for $x_1$ and $X_2$, which is in "Appendix" below. We are primarily interested in the amplitude ratio of the piston and alternator, so that the amplitude ratio is expressed using eq. (10). This gives:

$$\frac{\hat{X}_2}{X_1} = \frac{k_s}{(k_s-\omega^2m_2)+j\omega c_l} \quad \text{eq. (11)}$$

$$\left|\frac{X_2}{X_1}\right| = \frac{k_s}{[(k_s-\omega^2m_2)^2+(\omega c_l)^2]^{\frac{1}{2}}} \quad \text{eq. (12)}$$

$$\phi = \tan^{-1}\left\{\frac{\omega c_l}{k_s-\omega^2m_2}\right\} \quad \text{eq. (13)}$$

The expressions eq. (12) can be transformed in terms of "dimensionless quantities" or ratios only. There appear the frequency ratio and the damping ratio:

$$\left|\frac{X_2}{X_1}\right| = \frac{1}{\left[\left(1-\frac{\omega^2}{\omega_n^2}\right)^2+\left(2\frac{\omega}{\omega_n}\frac{c_l}{c_c}\right)^2\right]^{\frac{1}{2}}} \quad \text{eq. (14)}$$

Where:

$$\omega_n = \sqrt{\frac{k_s}{m_2}}:$$

Natural Frequency of the alternator moving component $c_c=2\sqrt{k_s m_2}$: Critical Damping At resonance point, the amplitude ratio becomes:

$$\left|\frac{X_2}{X_1}\right| = \frac{k_s}{\omega_n c_l} = \frac{\sqrt{k_s m_2}}{c_l} = \frac{c_c}{2c_l} \quad \text{eq. (15)}$$

From FIG. 7, we can find that the alternator amplitude can be higher than the piston amplitude when it is tuned to operate close to the alternator resonance frequency and the damping due to power dissipation in the alternator is smaller than a half critical damping. In other words, when the mass of the alternator moving component and the spring stiffness, $k_s$, are high enough to get the critical damping much higher than the alternator damping, it must be much easier to get the amplitude ratio higher than 1. When the damping ratio equals to 0.2, the amplitude ratio is over 2 within the frequency ratio range from 0.75 to 1.1.

Therefore, with proper tuning, the amplitude of the alternator can be any desired relation to the amplitude of the piston. The higher alternator amplitude is a great benefit in the high power machine because the optimum linear alternator power densities appear to occur at impractically high amplitudes. Therefore in the case of no spring between the piston and the alternator so they are rigidly connected, a critical factor in obtaining high specific power is related to the interaction of the dynamics of the thermodynamic cycle and the optimization of the alternator. For example, increasing the piston amplitude is favorable to the alternator but, for a given power, leads to a smaller piston diameter. This, in turn, leads to a smaller springing effect. Following this process soon leads the design to a point where the magnet mass cannot be sprung by the engine. Typically, the optimum point for minimum mass of the linear alternator and the engine do not coincide in the conventional machine for high power applications. The invention, however, helps to get the desired alternator amplitude regardless of the dynamics of the free-piston Stirling machine.

2. Power Output

In the conventional linear alternator system, the moving component of a linear alternator is connected to the piston rigidly. This gives the following governing equations.

$$F = m\ddot{x} + c\dot{x} + kx - P(t)A + \alpha i = 0 \quad \text{eq. (16)}$$

$$V = \alpha\dot{x} - Ri - L\frac{di}{dt} - \frac{1}{c}\int i dt \quad \text{eq. (17)}$$

Then power at the piston and the alternator can be obtained from:

$$\langle F, \dot{x}\rangle = \langle m\ddot{x}, \dot{x}\rangle + \langle c\dot{x}, \dot{x}\rangle + \langle kx, \dot{x}\rangle - \langle P(t)A, \dot{x}\rangle + \langle \alpha i, \dot{x}\rangle = 0 \quad \text{eq. (19)}$$

$$\langle V, i\rangle = \langle \alpha\dot{x}, i\rangle - \langle Ri, i\rangle - \left\langle L\frac{di}{dt}, i\right\rangle - \left\langle \frac{1}{c}\int i dt, i\right\rangle \quad \text{eq. (20)}$$

From the definition of orthogonality:

$$\langle \alpha i, \dot{x}\rangle = \langle P(t)A, \dot{x}\rangle - \langle c\dot{x}, \dot{x}\rangle \quad \text{eq. (21)}$$

$$P_{out} = \langle \alpha\dot{x}, i\rangle - \langle Ri, i\rangle \quad \text{eq. (22)}$$

Substituting (21) into (22):

$$P_{out} = \langle P(t)A, \dot{x}\rangle - \langle c\dot{x}, \dot{x}\rangle - \langle Ri, i\rangle = \int p dv - \langle c\dot{x}, \dot{x}\rangle - \langle Ri, i\rangle \quad \text{eq. (23)}$$

Thus power output is obtained by subtracting mechanical and electrical losses from the pv work. In the system with a spring between the piston and the alternator, we have two equations of motion for a piston, expressed by p and a moving component of the alternator, expressed by s.

$$F_p = m_p\ddot{x}_p + c_p\dot{x}_p + k_s x_p - k_s x_s - P(t)A = 0 \quad \text{eq. (24)}$$

$$F_s = m_s\ddot{x}_s + k_s x_s - k_s x_p + \alpha i = 0 \quad \text{eq. (25)}$$

$$V = \alpha\dot{x} - Ri - L\frac{di}{dt} - \frac{1}{c}\int i dt \quad \text{eq. (26)}$$

Then power can be obtained in the same way:

$$-\langle k_s x_s, \dot{x}_p\rangle = \langle P(t)A, \dot{x}_p\rangle - \langle c_p\dot{x}_p, \dot{x}_p\rangle \quad \text{eq. (27)}$$

$$\langle \alpha i, \dot{x}_s\rangle = \langle k_s x_p, \dot{x}_s\rangle \quad \text{eq. (28)}$$

$$P_{out} = \langle k_s x_p, \dot{x}_s\rangle - \langle Ri, i\rangle \quad \text{eq. (29)}$$

As discussed in the section 1, there is a phase shift between the piston amplitude and the alternator amplitude. Thus we can see that:

$$\langle x_s, \dot{x}_p\rangle = x_s x_p \cos(90+\phi) = -x_s x_p \sin\phi$$

$$\langle x_p, \dot{x}_s\rangle = x_s x_p \cos(90-\phi) = x_s x_p \sin\phi \quad \text{eq. (30)}$$

Therefore power output has the same form as (23), which means there is no additional loss in the new system with a spring installed between the piston and the moving component of alternator.

$$P_{out} = \langle P(t)A, \dot{x}\rangle - \langle c_p\dot{x}_p, \dot{x}_p\rangle - \langle Ri, i\rangle = \int p dv - \langle c_p\dot{x}_p, \dot{x}_p\rangle - \langle Ri, i\rangle \quad \text{eq. (31)}$$

3. Appendix: Exact Solutions of (3) and (4)

$$[(k_s-\omega^2 m_1)+j\omega c_1]X_1 - k_s\hat{X}_2 = \hat{P}A \quad \text{eq. (9)}$$

$$[(k_s-\omega^2 m_2)+j\omega c_l]\hat{X}_2 - k_s X_1 = 0 \quad \text{eq. (10)}$$

By expressing $X_2$ in terms of $x_1$, $$X_1 = \hat{P}A\frac{(k_s - \omega^2 m_1) + j\omega c_1}{[\omega^4 m_1 m_2 - \omega^2 k_s(m_1 + m_2) - \omega^2 c_1 c_l] + j\omega[c_1(k_s - \omega^2 m_2) + c_l(k_s - \omega^2 m_1)]} \quad \text{eq. (32)}$$

Then, $$\hat{X}_2 = \hat{P}A\frac{k_s}{[\omega^4 m_1 m_2 - \omega^2 k_s(m_1 + m_2) - \omega^2 c_1 c_l] + j\omega[c_1(k_s - \omega^2 m_2) + c_l(k_s - \omega^2 m_1)]} \quad \text{eq. (33)}$$

From (32) and (33), we can get the same amplitude ratio form as (11). Assuming no damping in the system and the same resonance frequency in two moving components, this system has the same solution form as that of the undamped dynamic vibration absorber.

When:

$$c_1 = c_l = 0$$

$$\omega_n = \sqrt{\frac{k_s}{m_1}} = \sqrt{\frac{k_s}{m_2}}$$

The solution is:

$$\frac{\hat{X}_2}{X_1} = \frac{1}{1 - \frac{\omega^2}{\omega_n^2}} \quad \text{eq. (34)}$$

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved combination of a free-piston Stirling machine including a reciprocatable power piston drivingly linked to an associated apparatus having a reciprocatable component body that is part of a mechanical load that the Stirling machine drives or of a prime mover that drives the Stirling machine, wherein the improvement comprises:

at least one spring connected to and drivingly linking the piston to the component body, there being no rigid connection linking the piston to the component body thereby permitting the piston and the component body to reciprocate at different amplitudes of oscillation.

2. An improved combination in accordance with claim 1, wherein there are a plurality of springs connected to and drivingly linking the piston to the component body.

3. An improved combination in accordance with claim 2, wherein there are an even number of springs connected to and drivingly linking the piston to the component body for canceling any torque force exerted by the springs when an axial force is applied to them.

4. An improved combination in accordance with claim 3, wherein the springs are coil springs.

5. An improved combination in accordance with claim 1, wherein the free-piston Stirling machine is an engine and the reciprocatable component body is a reciprocating component body of a linear alternator driven by the engine for driving the reciprocating component body of the linear alternator in reciprocation at an amplitude of reciprocation $X_2$ that is greater than the amplitude of reciprocation $X_1$ of the piston.

6. An improved combination in accordance with claim 1, wherein the spring, the mass of the reciprocatable component body, the damping of the reciprocatable component body and the operating ratio of the component body amplitude of reciprocation to the power piston amplitude of reciprocation, when the combination is operated at the natural frequency $\omega_n$ of oscillation of the component body, are related in accordance with $$\left|\frac{X_2}{X_1}\right| = \frac{\sqrt{k_s m_2}}{c_l}$$

wherein $k_s$ is the spring constant of the spring;

$m_2$ is the mass of the reciprocatable component body;

$c_l$ is a damping constant for damping of the reciprocatable component body;

$X_2$ is the amplitude of reciprocation of the component body;

$X_1$ is the amplitude of reciprocation of the power piston; and $$\omega_n = \sqrt{\frac{k_s}{m_2}}.$$

7. An improved combination in accordance with claim 6, wherein the free-piston Stirling machine is an engine and the reciprocatable component body is a reciprocating component body of a linear alternator driven by the engine for driving the reciprocating component body of the linear alternator in reciprocation to generate electrical power, wherein the damping constant $c_l$ represents damping of the linear alternator by electrical power dissipation in the linear alternator circuit, and wherein $$c_l = \alpha\frac{di}{d\dot{x}_2},$$

wherein $\alpha$ is the motor constant of the linear alternator, $\dot{x}_2$ is the velocity of the component body and i is a current in the linear alternator.

8. An improved combination in accordance with claim 7, wherein the damping ratio $$\frac{c_l}{c_c}$$

is less than 0.5, $c_c$ being the critical damping constant defined by $c_c=2\sqrt{k_s m_2}$.

9. An improved combination in accordance with claim 8, wherein the damping ratio $$\frac{c_l}{c_c}$$

is less than 0.2.

10. A method for designing, fabricating and operating a combination of a free-piston Stirling machine including a reciprocatable power piston drivingly linked to an associated apparatus having a reciprocatable component body that is part of a mechanical load that the Stirling machine drives or is a part of a prime mover that drives the Stirling machine, wherein the method comprises:

connecting and drivingly linking the piston to the component body by at least one spring with no rigid connection linking the piston to the component body, and designing the spring, the mass of the reciprocatable component body, the damping of the reciprocatable component body and the operating ratio of the component body amplitude of reciprocation to the power piston amplitude of reciprocation, when the combination is operated at the natural frequency $\omega_n$ of oscillation of the component body, to have a relationship between them in accordance with $$\left|\frac{X_2}{X_1}\right| = \frac{\sqrt{k_s m_2}}{c_l}$$

wherein $k_s$ is the spring constant of the spring;

$m_2$ is the mass of the reciprocatable component body;

$c_l$ is a damping constant for damping of the reciprocatable component body;

$X_2$ is the amplitude of reciprocation of the component body;

$X_1$ is the amplitude of reciprocation of the power piston; and $$\omega_n = \sqrt{\frac{k_s}{m_2}}.$$

11. A method in accordance with claim 10 wherein the associated apparatus is a linear alternator or a linear motor and the method further comprises designing the spring as having a spring constant $k_s$ and designing the alternator or motor as having (a) a mass $m_2$, (b) a motor constant $\alpha$ (c) a ratio of electrical current i to piston velocity $\dot{x}_2$ (d) a damping constant $c_l$ and (e) a damping ratio less than 0.5, wherein the damping ratio is $$\frac{c_l}{c_c}$$

the damping constant is $$c_l = \alpha\frac{di}{d\dot{x}_2},$$

the motor constant is $$\alpha = \frac{v(alt./\text{motor}-\text{volts})}{\dot{x}_2(alt./\text{motor}-\text{velocity}-\text{m/sec})} = \frac{\text{force (newtons)}}{alt./\text{motor}-\text{current (amps)}},$$

and the critical damping constant is $c_c=2\sqrt{k_s m_2}$.

12. A method in accordance with claim 11 and more particularly comprising designing the alternator or motor as having a critical damping ratio no greater than 0.2.

13. A method in accordance with claim 12 and further comprising operating the combination at an operating frequency in the range of 0.75 $\omega_n$ and 1.11 $\omega_n$.

* * * * *